United States Patent [19]

Liu

[11] 4,353,321

[45] Oct. 12, 1982

[54] WATERBIKE

[76] Inventor: Gordon Y. T. Liu, 12336 Parkwood Ave., Baton Rouge, La. 70815

[21] Appl. No.: 157,508

[22] Filed: Jun. 9, 1980

[51] Int. Cl.[3] ..... B63B 1/20

[52] U.S. Cl. ..... 114/283; 114/61; 114/123

[58] Field of Search ..... 114/270, 123, 283, 61; 9/2 C

[56] References Cited

U.S. PATENT DOCUMENTS

| | | | |
|---|---|---|---|
| 3,139,058 | 6/1964 | Robinson | 114/61 |
| 3,276,413 | 10/1966 | Dolph et al. | 114/123 |
| 3,373,715 | 3/1968 | Stacey | 114/270 |
| 3,483,844 | 12/1969 | Trautwein | 114/270 |
| 3,756,189 | 9/1973 | Yutzler | 114/270 |
| 3,922,994 | 12/1975 | DeLong | 114/281 |
| 3,996,874 | 12/1976 | Winch | 114/61 |

FOREIGN PATENT DOCUMENTS

| | | | |
|---|---|---|---|
| 703409 | 12/1979 | U.S.S.R. | 114/144 R |

*Primary Examiner*—Edward R. Kazenske
*Assistant Examiner*—Thomas J. Brahan
*Attorney, Agent, or Firm*—Arthur J. Young; Reginald F. Roberts, Jr.

[57] ABSTRACT

A waterbike characterized by front-end steering and horizontal stabilizing floatation members, these features providing increased maneuverability at high speeds and stability at low speeds or in a stationary position.

3 Claims, 3 Drawing Figures

WATERBIKE

BACKGROUND OF THE INVENTION

This invention relates to a waterborne vehicle. More particularly, this invention relates to a waterbike with front-end steering and horizontal stabilizing floatation members.

The marine craft presently known include a number of waterborne vehicles whose primary purpose is recreation. Such vehicles generally provide rear-end steering and/or fixed stabilization means, which do not have the degree of maneuverability and stability which the present invention provides by virtue of its front-end steering and its specially-designed adjustable stabilizing floatation members.

SUMMARY

In general, this invention provides a waterbike with front-end steering and adjustable stabilizing floatation means. The waterbike includes a first floatation member, including steering means; a second floatation member, including support means for a rider, located aft along the horizontal axis of the waterbike and connected to the first floatation member; and third and fourth floatation members, located aft along the horizontal axis of the waterbike and connected to the second floatation member, and including means for varying the horizontal position of the third and fourth floatation members relative to one another and perpendicular to the horizontal axis of the waterbike, whereby the third and fourth floatation members are in a closed juxtaposed position when the waterbike is traveling at a relatively high speed, and are disposed away from each other in a stabilizing position substantially perpendicular to the horizontal axis of the waterbike to provide vertical stability when the waterbike is stationary or traveling at a relatively low speed.

The front-end steering of the present waterbike is highly beneficial for a number of reasons. For example, there is little or no time lag when executing a maneuver with front-end steering, which may be particularly critical when the vehicle is traveling at a high speed. Moreover, most individuals who purchase and operate waterbikes are likely to be experienced in the use of land vehicles with front-end steering, which experience can be put to beneficial use with the waterbike.

An additional consideration is that a waterbike performs most efficiently when it encounters the least amount of water resistance, particularly when cruising at high speeds through the water. As soon as a waterbike begins to slow down, however, it becomes vertically unstable. The adjustable horizontal stabilizing floatation members of the present waterbike provide both a streamlined profile at high speeds and excellent vertical stability at low speeds or in a stationary position. Both maneuverability and stability are improved in the present invention by virtue of its specially-designed stabilizing members. The position of the stabilizing members may be controlled either manually or automatically. For example, any known automatic spring mechanism can be used which would have sufficient force to overcome water pressure on the stabilizing members when the waterbike is moving slowly or is stationary in the water, thus moving the stabilizing members horizontally away from each other to provide vertical stability, but would not have sufficient force to prevent the stabilizing members from coming together in a juxtaposed position when the waterbike is traveling at a high speed. The stabilizing members can also be controlled manually with such means as a heavy-duty cable and sheath similar to that used for a manual choke on an engine carburetor. A maximum degree of flexibility and control is achieved by the person operating the waterbike when a manual system is used.

The waterbike may be constructed of any suitable materials. For example, the frame and steering mechanism may be constructed of carbon steel or chrome steel similar to that used on bicycles or motorcycles, and the floatation members may be constructed of a polyester reinforced fiberglass or aluminum. In addition, the steering mechanism can be designed similar to those presently used on bicycles or motorcycles.

It is an object of this invention to provide a waterbike useful as a source of recreation. It is a further object of this invention to provide a waterbike of superior maneuverability. It is a still further object of this invention to provide a waterbike with improved vertical stability and maneuverability. These and other objects of this invention will be apparent to those skilled in the art from the more detailed description which follows.

BRIEF DESCRIPTION OF THE DRAWINGS

The objects and advantages of the present invention are even more apparent when taken in conjunction with the accompanying drawings, in which like characters of reference designate corresponding materials and parts throughout the several views thereof, in which.

DESCRIPTION OF THE PREFERRED EMBODIMENTS

The following description illustrates the manner in which the principles of the invention are applied, but is not to be construed as limiting the scope of the invention.

Figure 1:
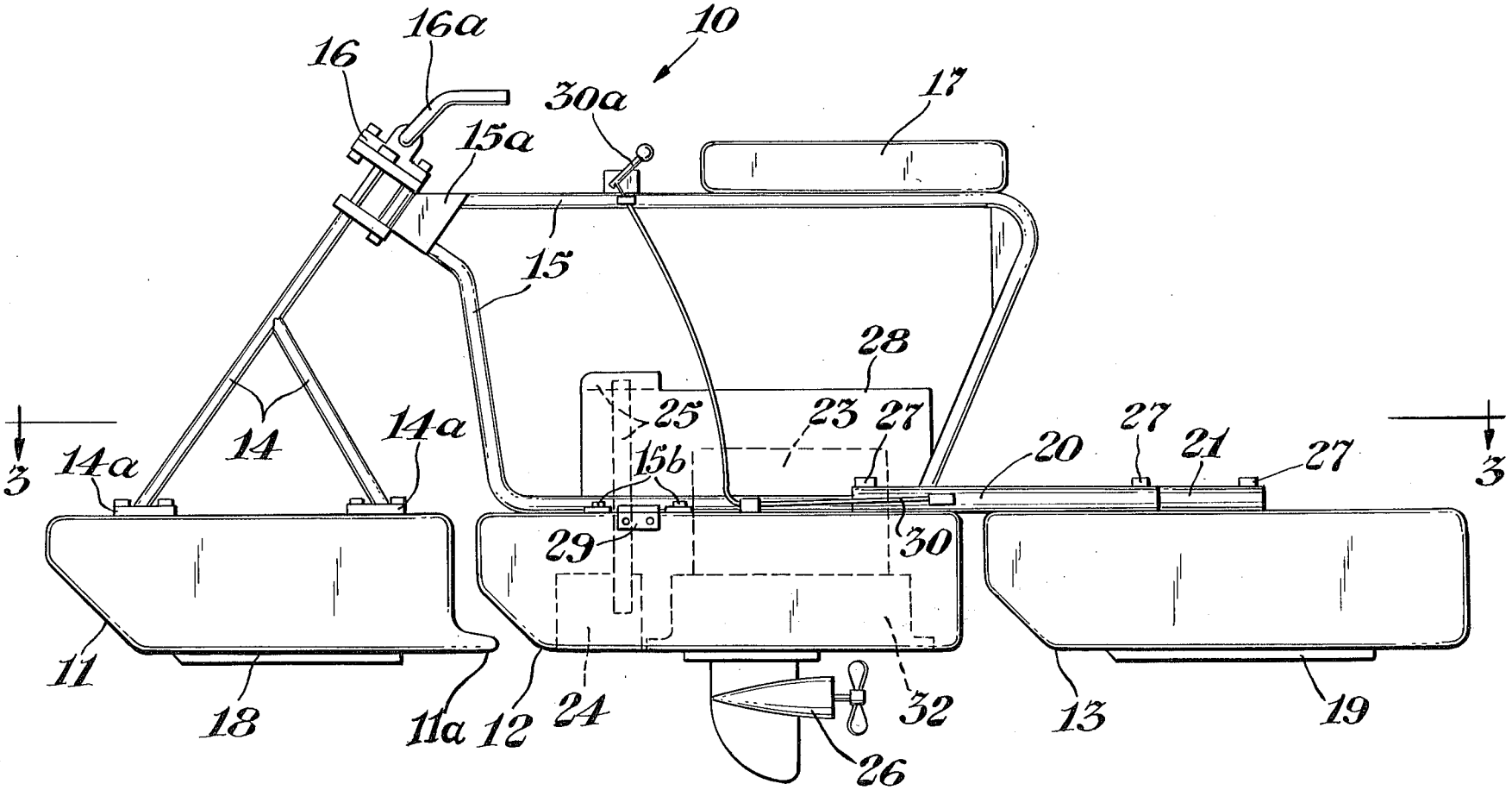
FIG. 1 is a side view of a waterbike constructed according to the principles of the present invention.
Figure 3:
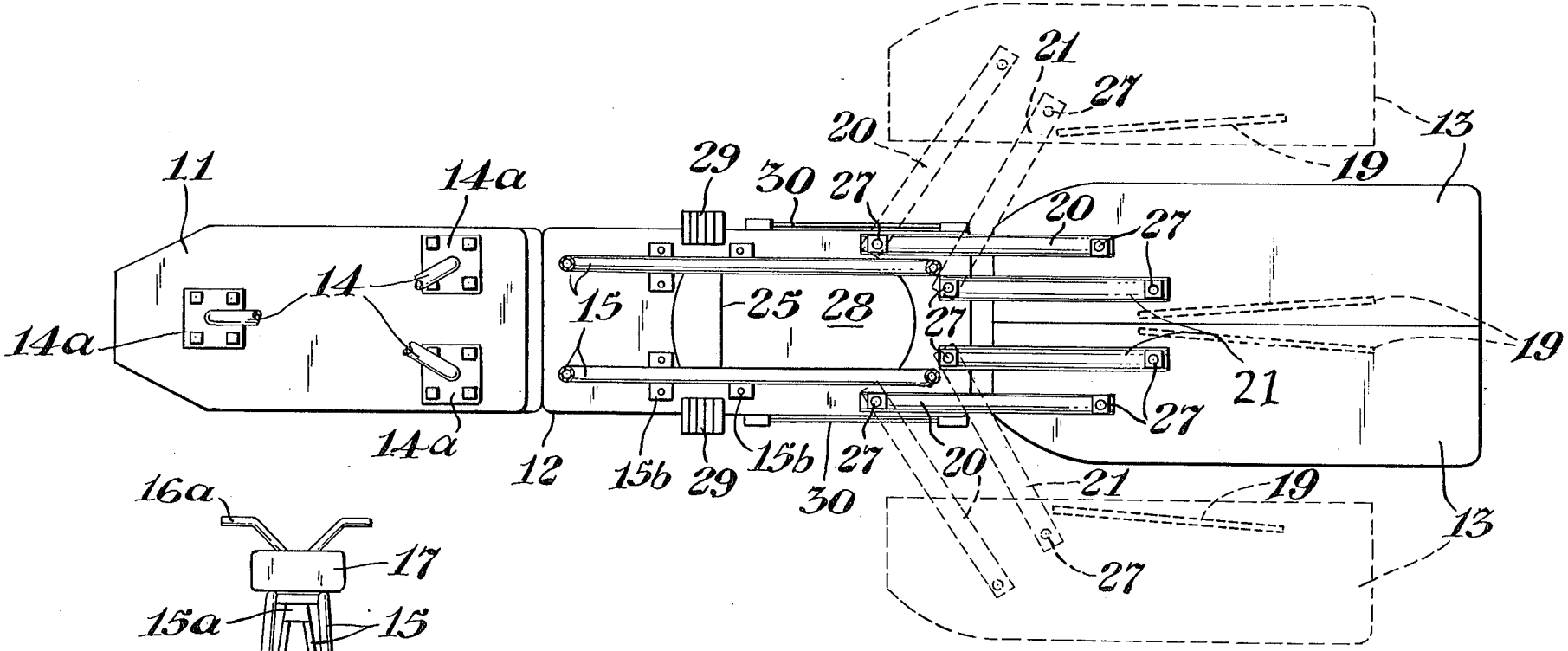
FIG. 3 is a cross section, taken along line 3—3 of FIG. 1, illustrating two different positions of the pontoons of the waterbike constructed according to the principles of the present invention.
Figure 2:
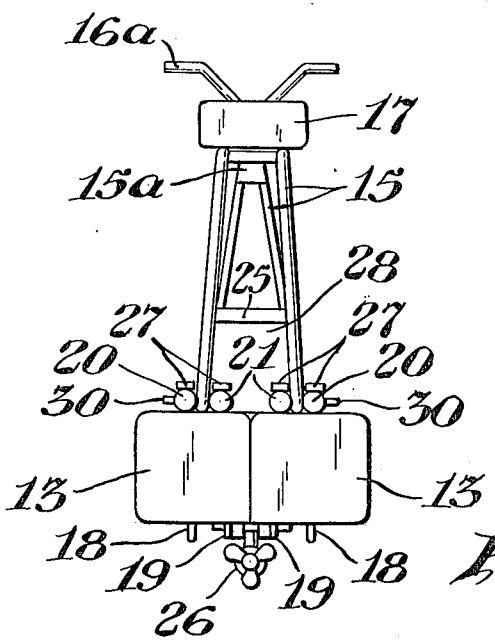
FIG. 2 is a rear view of the waterbike shown in FIG. 1 constructed according to the principles of the present invention.

More specifically, referring to FIGS. 1–3, a self-propelled waterbike 10 is illustrated. The waterbike 10 has a front pontoon 11, a middle pontoon 12, and two rear pontoons 13 to provide floatation for the waterbike 10 in the water.

A tubular frame 14 is fixed to pontoon 11 by fasteners 14*a*. In like manner, a second tubular frame 15 is fixed to the middle pontoon 12 with fasteners 15*b*. A seat 17 is fixed to the frame 15 to provide support for riders. The front pontoon 11 is connected to the middle pontoon 12 in a pivotal relationship by a flange 15*a*, fixed to frame 15, and pivotal assembly 16, which is similar to that of a bicycle or motorcycle, fixed to frame 14. The front-end steering mechanism is completed by fins 18 attached to the bottom of the front pontoon 11, which provides improved steerage for the waterbike 10, and handlebars 16*a* for the rider to steer the waterbike 10.

The propulsion means for the waterbike 10 is provided by a marine engine 23 and a lower propeller assembly 26 disposed within the middle pontoon 12. A jet-type lower propulsion assembly may also be used, if desired. A fixed gas tank 32 is also provided for the marine engine 23. Conventional, well-known start, shift, and throttle means, not shown, are provided for the marine engine 23. In addition, a waterproof cover 28 is placed over engine 23 to prevent it from becoming wet during operation of the waterbike 10. An air-intake system for the engine 23 is also provided, including an inlet and tube 25 and chamber 24, which will permit air to reach the engine 23 but will prevent water from reaching the engine 23 when the waterbike is accidentally turned over during operation. Vents, not shown, are positioned near the bottom of chamber 24 to allow air to reach the engine 23. However, the design of chamber 24 will prevent water from siphoning into the engine compartment when the waterbike 10 is overturned for an extended period of time.

The pontoons 13 are connected to pontoon 12 in a pivotal relation by rods 20 and 21. Rods 20 and 21 are fastened to pontoons 12 and 13 by bolts 27. As shown in FIG. 3, the pontoons 13 may be positioned together in a juxtaposed position or in a position away from one another, in phantom line, substantially perpendicular to the horizontal axis of the waterbike 10. When pontoons 13 are in a juxtaposed position and rods 20 and 21 are the same length and parallel, the pontoons 13 will remain in a substantially parallel position relative to each other as they are moved away from each other. However, the pontoons 13 may be changed to a variety of biased positions, relative to the horizontal axis of the waterbike 10, as they are moved away from one another. For example, the front end of pontoons 13 may be positioned closer to or farther away from the horizontal axis of the waterbike 10 than the aft end of the pontoons 13. This can be accomplished by making rods 20 a different length than rods 21 and/or by fixing rods 20 and 21 in a non-parallel relationship when pontoons 13 are in a juxtaposed position.

The position of pontoons 13 can be adjusted by a heavy-duty cable and sheath assembly 30 similar to that used for a manual choke on an engine carburetor. In operation, the cables of assembly 30 are fastened to rods 20 on one end and to a handle **30*a* on the other end. The sheaths of assembly 30 are attached to the frame 15, thereby allowing a force to be transmitted through the cables from the handle 30*a* to the rods 20, thus causing the pontoons 13 to move away from one another. As the speed of the waterbike 10 is increased, the handle 30*a* can be released, thereby permitting the pontoons 13 to return to a juxtaposed position as a result of water pressure against them. To ensure that the pontoons 13 will return to and remain in a juxtaposed position when handle 30*a* is released, fins 19, fixed to the bottom of pontoons 12, are provided. Fins 19 are biased outwardly from front to aft along pontoons 13, thereby causing increased inward pressure against pontoons 13 as the speed of the waterbike 10** is increased.

The waterbike 10 also includes pedals 29 fixed to pontoon 12 to provide a foot hold for the rider. In addition, an extension **11*a* is provided on the bottom aft edge of pontoon 11 which extends beyond the forward bottom edge of pontoon 12. Extension 11*a* prevents water turbulence between pontoons 11 and 12 that could interfere with the operation of the waterbike 10. The waterbike 10** may be self-propelled as shown in the above preferred embodiments, or it may be towed by a line attached to antoher powered vessel.

While certain representative embodiments and details have been shown for the purpose of illustrating the invention, it will be apparent to those skilled in the art that various changes and modifications can be made therein without departing from the spirit and scope of the invention.

What is claimed is:

1. A waterbike, comprising: a first floatation member, including steering means; a second floatation member, including support means for a rider, said support means rigidly connected to the second floatation member in a fixed relationship, said second floatation member located aft along the horizontal axis of the waterbike and connected to the first floatation member; a third and a fourth flotation member means for varying the horizontal position of the third and fourth floatation members relative to one another and perpendicular to the horizontal axis of the waterbike, said position-varying means including a cable assembly, whereby the third and fourth floatation members are in a closed juxtaposed position when the waterbike is traveling at a relatively high speed and are disposed away from each other in a stabilizing position substantially perpendicular to the horizontal axis of the waterbike to provide vertical stability when the waterbike is stationary or traveling at a relatively low speed, said third and fourth floatation members further including vertically-positioned fins fixed to the bottoms thereof, said fins extending in a biased position along the bottom of the third and fourth floatation members relative to the horizontal axis of the waterbike, whereby the third and fourth floatation members are forced by the water pressure into a juxtaposed position as the speed of the waterbike is increased.

2. The waterbike of claim 1, further comprising an engine and propulsion means to drive the waterbike through the water, said engine and propulsion means characterized as rigidly fastened to the second floatation member in a fixed relationship.

3. The waterbike of claim 2, wherein the first floatation member includes an extension at its bottom aft edge which extends aft of the forward bottom edge of the second floatation member, whereby said extension substantially reduces water turbulence between the first and second floatation members when the waterbike is traveling at a relatively high speed.

* * * * *